United States Patent [19]

Burke

[11] 4,162,380

[45] Jul. 24, 1979

[54] WAVEGUIDE ASSEMBLY FOR MICROWAVE OVEN

[75] Inventor: Harry D. Burke, Marion, Ohio

[73] Assignee: Whirlpool Corporation, Benton Harbor, Mich.

[21] Appl. No.: 801,724

[22] Filed: May 31, 1977

[51] Int. Cl.[2] ..... H05B 9/06

[52] U.S. Cl. ..... 219/10.55 F; 219/10.55 D

[58] Field of Search ..... 219/10.55 F, 10.55 D, 219/10.55 R; 333/95 R, 95 S, 98 R

[56] References Cited

U.S. PATENT DOCUMENTS

| | | | |
|---|---|---|---|
| 3,296,405 | 1/1967 | McAvoy et al. | 219/10.55 F |
| 3,430,022 | 2/1969 | Cougoule | 219/10.55 F |
| 3,440,385 | 4/1969 | Smith | 219/10.55 R |
| 3,867,605 | 2/1975 | Yee | 219/10.55 D |
| 3,867,607 | 2/1975 | Ohtani | 219/10.55 R |
| 4,049,938 | 9/1977 | Ueno | 219/10.55 F |

*Primary Examiner*—Arthur T. Grimley

*Attorney, Agent, or Firm*—Wegner, Stellman, McCord, Wiles & Wood

[57] ABSTRACT

A waveguide structure for use in a microwave oven wherein a portion of the wall structure defining the oven cavity also forms a portion of the waveguide. The waveguide is formed of a plurality of wall members cooperatively defining a waveguide conduit for delivering microwave energy from a generator through an inlet opening in the oven cavity wall. The several wall members of the waveguide conduit are pressformed and secured together by mechanical fastening structure to provide high accuracy in the waveguide configuration. The conduit wall further includes a mounting flange secured to the cavity wall to provide further precise accurate association of the waveguide conduit with the cavity wall opening. An external paint coating on the cavity wall defines with a mounting flange of the waveguide conduit wall a capacitive seal therebetween.

19 Claims, 5 Drawing Figures

FIG. 3
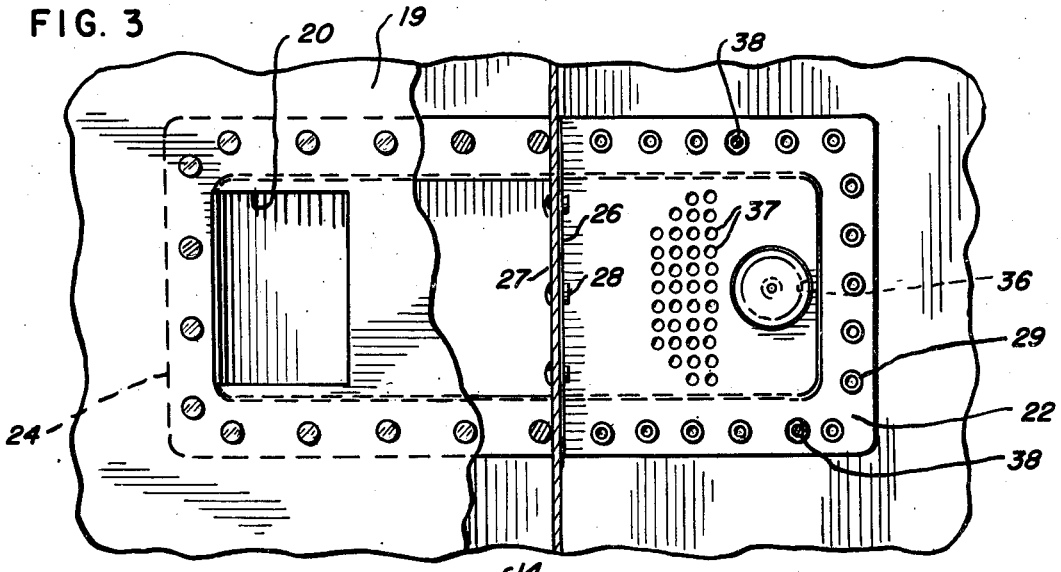
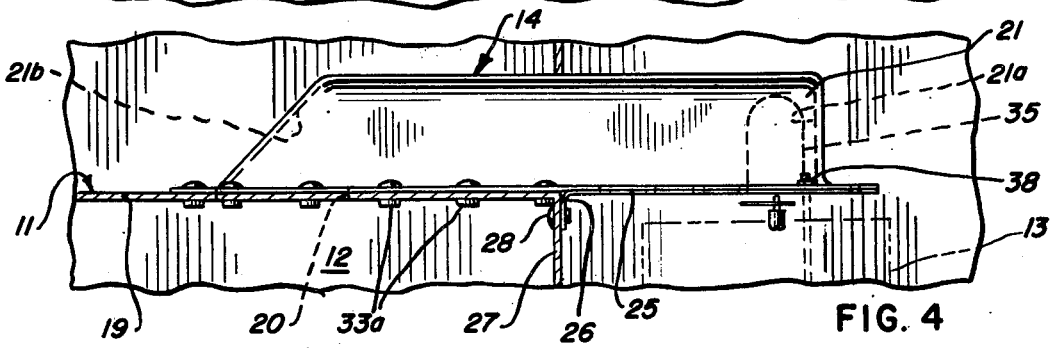
FIG. 4
FIG. 2
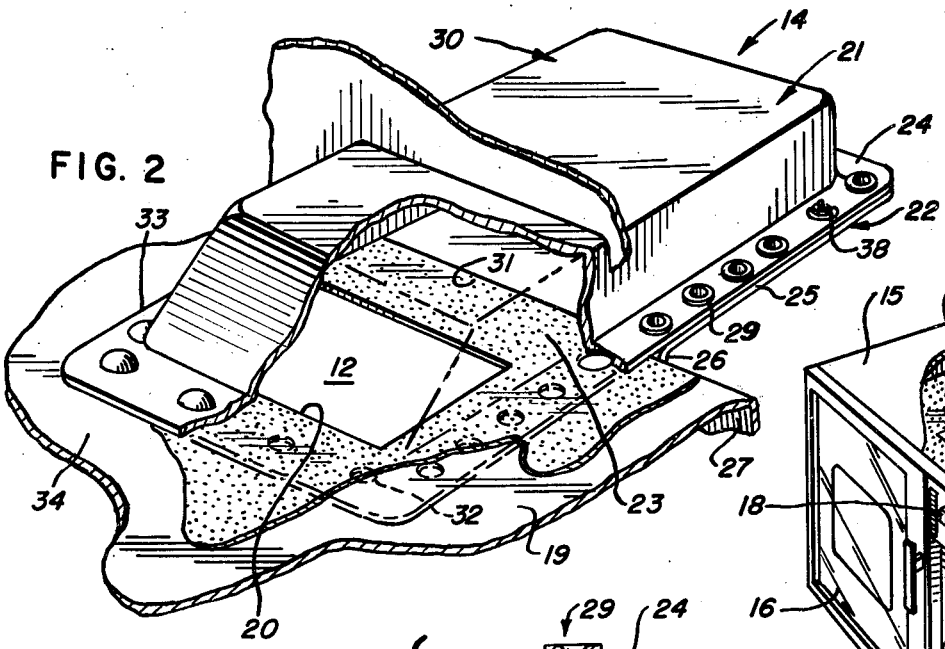
FIG. 1
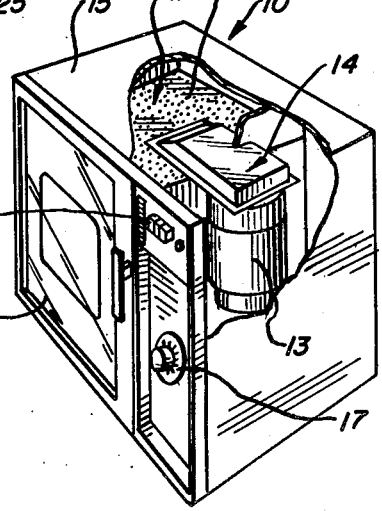
FIG. 5
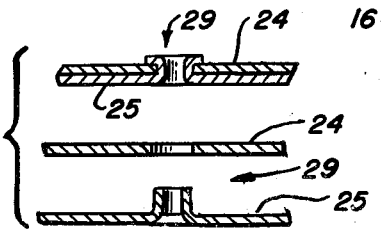

WAVEGUIDE ASSEMBLY FOR MICROWAVE OVEN

BACKGROUND OF THE INVENTION

1. Field of the Invention

This invention relates to microwave waveguides and in particular to microwave waveguides for use such as in ovens.

2. Description of the Prior Art

In the construction of microwave ovens, the oven cavity is defined by a plurality of walls one of which has an inlet opening. The microwave energy is conventionally propagated by a suitable generator and conducted through a waveguide defining a microwave conduit leading from the generator to the cavity inlet opening.

The dimensions of the waveguide and cavity must be maintained with a high degree of accuracy as they are critical in controlling the efficiency of distribution of microwave energy for heating purposes in the cavity. More specifically, it has been found that such critical dimensions include the physical dimensions of the waveguide, the physical dimensions of the cavity, the distance from the centerline of the generator tube filament to the back surface of the waveguide, the distance from the centerline of the tube filament to the front surface of the waveguide, and the location and size of the inlet opening to the cavity.

A number of different waveguide structures have been developed for use in such oven applications. Illustratively, Robert L. Cougoule, in U.S. Pat. No. 3,430,022, shows a microwave oven wherein the waveguide includes a pair of passages, one of which is defined by a pair of parallel spaced slots and the other of which contains a large iris for respectively favoring introduction of the E field and the H field.

In U.S. Pat. No. 3,437,777 of Torao Nagai et al, a microwave heating apparatus is shown having a branched rectangular waveguide.

Werner Golombek et al, in U.S. Pat. No. 3,522,550, show a microwave oven having a waveguide of preselected length adapted to utilize a long line cable reaction effect.

William C. Jones et al, in U.S. Pat. No. 3,662,140, show a high frequency heating apparatus having sensing and protective means within the transmission line coupling the generator to the heating apparatus.

Richard Ironfield, in U.S. Pat. Nos. 3,758,737 and 3,819,900, shows a waveguide for a microwave oven provided with a filter for defining, with the waveguide walls, parallel transmission paths.

Kenneth L. Carr et al, in U.S. Pat. No. 3,806,837, show a plug-in waveguide isolator in a three-port waveguide function circulator. The circulator is disposed in a rigid section of rectangular waveguide structure to fit closely within the transmission line. The waveguide structure may be made of two identical rigid castings.

In U.S. Pat. No. 3,909,754 of Harry F. Hapell, a waveguide filter is shown in a waveguide formed integrally with the oven cavity wall.

In assembling certain structures, integral securing portions may be utilized. Illustratively, in U.S. Pat. No. 1,203,688 of Edwin F. Beugler, a barrel hoop is provided with integral mechanical fastening structure comprising one or more lips, tongues, hooks, or offset portions adapted to interlock with each other.

In U.S. Pat. No. 3,127,789, of Heinrich van de Loo, a foot pedal structure for bicycles and the like is disclosed. Tubular rivets are formed integrally in leg portions of the U-shaped stirrups.

SUMMARY OF THE INVENTION

The present invention comprehends an improved waveguide means for use in a microwave oven having wall means defining an oven cavity provided with an inlet opening. The waveguide is arranged to provide a highly accurate and precise configuration for providing effectively maximum efficiency in conducting microwave energy from a conventional microwave generator into the cavity.

More specifically, the invention comprehends providing such a waveguide including a first waveguide member and a second waveguide member secured in sealed relationship to the first waveguide member to define therewith a partial waveguide conduit having an inlet opening and an outlet opening, the partial waveguide conduit being secured in sealed relationship to the oven wall means with the conduit outlet opening aligned with the wall means inlet opening to define a substantially closed conduit for conducting microwave energy from the generating means successively through the conduit inlet opening, through the conduit, and through the aligned conduit outlet opening and wall means inlet opening into the cavity, the conduit outlet opening being larger than the wall means inlet opening whereby the wall means adjacent the inlet opening defines with the partial waveguide conduit the improved waveguide.

In the illustrated embodiment, the first and second waveguide members are joined by cooperating integral rivet means.

To provide accurate alignment of the conduit with the cavity inlet opening, a flange may be provided on one of the waveguide members adapted to be fixedly secured to the wall means.

Each of the waveguide members may comprise a solely press-formed member with a mechanical fastening means avoiding deformation thereof during the assembly and thereby maintaining the desired high dimensional accuracy.

The waveguide members may be provided with outturned flanges which may be secured in facial abutment by the mechanical fastening means.

The cavity wall means may be provided with an external coating, such as of dielectric paint, which may be interposed between a securing portion of the conduit means and the cavity wall means to define a capacitive seal therebetween.

The peripheral mounting flanges of the waveguide members may have an optimum width of approximately 1 inch.

The mechanical fastening means is preferably spaced apart a distance less than one-quarter the wavelength of the microwave energy provided by the generator.

The waveguide construction of the present invention is extremely simple and economical while yet providing the highly desirable dimensional accuracy and other features discussed above.

BRIEF DESCRIPTION OF THE DRAWING

Other features and advantages of the invention will be apparent from the following description taken in connection with the accompanying drawing wherein:

FIG. 1 is a perspective view of a microwave oven with portions broken away to illustrate the installation therein of a waveguide embodying the invention;

FIG. 2 is a fragmentary enlarged perspective view with portions broken away illustrating more specifically the waveguide construction;

FIG. 3 is a fragmentary bottom plan view with portions broken away to facilitate illustration of the structure;

FIG. 4 is a fragmentary side elevation thereof; and

FIG. 5 is an enlarged view in cross section of one integral rivet of the waveguide showing the rivet means both before and after assembly.

DESCRIPTION OF THE PREFERRED EMBODIMENT

In the exemplary embodiment of the invention as disclosed in the drawing, a microwave oven generally designated 10 is provided with wall means generally designated 11 defining a cavity 12 in which food products and the like may be placed for heating by microwave energy delivered into the cavity. The microwave energy may be generated by a conventional microwave energy generator 13 and is delivered from the generator to the cavity by means of a waveguide generally designated 14.

As shown in FIG. 1, the oven may include an outer cabinet 15 having a front door 16 for providing selective access to the cavity 12. Suitable controls 17 and 18 may be provided on the front of the cabinet for controlling the operation of the oven as desired. As further shown in FIG. 1, the generator 13 may be disposed at one side of the cavity wall means 11 within the outer cabinet 15, and the waveguide extends from the generator to overlie a top wall 19 of the wall means 11. As shown in FIG. 2, the top wall is provided with an opening 20 which defines an inlet opening to the cavity 12 for conducting the microwave energy from the waveguide downwardly through the top wall into the cavity.

In the illustrated embodiment, the waveguide 14 is effectively defined by a first press-formed wall member 21, a second press-formed wall member 22, and a portion 23 of top wall 19 of wall means 11.

As best seen in FIGS. 2 and 4, wall member 21 defines a downwardly opening dish-shaped member having a peripheral flange 24 outturned from the dish-shaped portion to overlie and have facial abutment with a complementary flange 25 of the second wall member 22. As best seen in FIG. 4, flange 25 terminates adjacent the midportion of the waveguide in a downturned portion 26 which is adapted to be secured to the sidewall 27 of cavity wall means 11 by suitable mechanical fastening means, such as pop rivet means 28.

Flanges 24 and 25 are fixedly secured in facial abutting relationship by integral mechanical fastening means generally designated 29. In the illustrated embodiment, the mechanical fastening means 29 comprises integral rivet means having complementary portions formed as shown in FIG. 5 in the respective flanges 24 and 25. The rivet means may be formed in the flanges by the press-forming operation and may be set in a conventional setting operation to secure the flanges as shown in FIGS. 2 and 4.

As the bottom wall member 22 terminates at sidewall 27 of the cavity wall means 11, the lefthand end of the upper wall member 21, as seen in FIGS. 2 and 4, opens downwardly onto the top wall portion 23 defining the cavity inlet opening 20. Thus, the wall members 21 and 22 cooperatively define a partial waveguide conduit structure generally designated 30 having a relatively large outlet opening 31 generally aligned with the cavity inlet opening 20. Effectively, the outlet opening 31 is partially closed by the wall mean portion 23 so that the wall portion 23 effectively defines a third portion of the waveguide. As shown in FIG. 2, the wall portion 23 may be provided with suitable press-formed holes 32 for cooperation with corresponding holes defined in flange 24 so that fastening means 33, which may comprise a plurality of pop rivets **33*a*, may be employed to provide mechanical fastening means securing the flange 24 in facial confronting relationship to the top wall portion 23**.

In the illustrated embodiment, the top wall portion 23 may be provided with a protective coating, such as of dielectric paint, 34. The paint coating interposed between flange 24 and wall portion 23 effectively defines a capacitive seal therebetween surrounding the opening 20.

In the illustrated embodiment, the generator 13 comprises a conventional magnetron assembly with the filament portion 35 thereof extending upwardly through an opening 36 in wall member 22 at the right-hand end of the waveguide assembly, as seen in FIGS. 3 and 4. Wall member 22 may further be provided with a plurality of small apertures 37 for passing air outwardly from adjacent the magnetron generator into the waveguide 14.

In the illustrated embodiment, the flange 24 has a width of approximately 1" with a spacing of the rivets 33*a* therealong being preferably no more than one-quarter the wavelength of the fundamental frequency of the microwave energy propagated by generator 13. The press forming of the flanges 24 and 25 permits the flanges to be maintained highly accurately in their planar contact so as to provide an accurate face-to-face engagement therebetween upon the securing of the integral rivets 29. The press forming operations permit the different elements of the waveguide to be precisely formed so as to provide desired high accuracy in the dimensions of the waveguide. Further, the provision of flange 26 accurately formed in the lower waveguide wall member 22 permits a highly accurate location of the waveguide on the cavity wall means 11 thereby accurately controlling the relationship of opening 20 in the top wall 19 thereof to the partial waveguide structure 30.

The magnetron 13 may be accurately aligned with the opening 36 in the bottom wall member 22 to assure the location of the centerline of the tube filament portion 35 with respect to the waveguide structure 30, particularly the back surface **21*a* and the front surface 21*b* of wall member 21. Since the waveguide structure 30 is precisely aligned with opening 20 in top wall 19, the centerline of filament portion 35 will also be precisely located with respect to opening 20**.

As will be obvious to those skilled in the art, the forming of the cooperating rivet portions may be such as to provide the upset portions in either of the mating wall members. The use of the integral rivet means prevents distortion of the parts and provides maintained high accuracy in the dimensions of the waveguide while yet permitting facilitated assembly and long maintenance-free life of the structure.

By eliminating deformation of the elements of the waveguide structure during the assembly and installation thereof in the apparatus, microwave energy leakage is kept to a minimum, thereby increasing both the safety and the efficiency of the operation of the oven.

By utilizing a portion of the oven top wall itself as a portion of the waveguide in the manner disclosed above, maintenance of the desired high accuracy in the configuration of the waveguide is effectively facilitated.

In the illustrated embodiment, the generator 13 is secured to the waveguide wall member 22 by means of suitable fasteners 38 as seen in FIGS. 3 and 4. As further shown therein, the securing means synergistically further serves as means for securing the flanges 24 and 25 of the waveguide portion 22 in maintained association. As the holes for the fastening means 38 may also be preformed in the waveguide portions, high accuracy in the mounting of the generator relative to the waveguide is obtained.

The foregoing disclosure of specific embodiments is illustrative of the broad inventive concepts comprehended by the invention.

The embodiments of the invention in which an exclusive property or privilege is claimed are defined as follows:

1. In a microwave oven having wall means defining an oven cavity, said wall means defining an inlet opening, and microwave energy generating means externally of said cavity, an improved waveguide for delivering microwave energy from said generating means through said inlet opening into said cavity, comprising:

a first waveguide member; and a second waveguide member secured in sealed relationship to said first waveguide member to define therewith a partial waveguide conduit having an inlet opening and an outlet opening, said partial waveguide conduit being secured in sealed relationship to said wall means with said partial waveguide conduit outlet opening generally aligned with said wall means inlet opening to define a substantially closed conduit for conducting microwave energy from said generating means successively through said partial waveguide conduit inlet opening through said partial waveguide conduit, and through said aligned partial waveguide conduit outlet opening and wall means inlet opening into said cavity, said partial waveguide conduit outlet opening being substantially larger than said wall means inlet opening and overlying the wall means about said inlet opening whereby a substantial portion of said wall means adjacent said wall means inlet opening defines with said partial waveguide conduit said improved waveguide.

2. The microwave oven waveguide of claim 1 wherein said wall means defines a top wall of the cavity and said wall means inlet opening is in said top wall.

3. The microwave oven waveguide of claim 1 wherein at least one of said waveguide members is provided with one integral flange fixedly secured to said wall means to facilitate accurate alignment of said partial waveguide conduit with said wall means inlet opening.

4. The microwave oven waveguide of claim 1 wherein each of said waveguide members comprises a solely press-formed member.

5. The microwave oven waveguide of claim 1 wherein said wall means comprises a solely press-formed member.

6. The microwave oven waveguide of claim 1 wherein said first waveguide member includes a mounting flange exteriorly of said conduit and said waveguide includes means securing said mounting flange to said wall means.

7. The microwave oven waveguide of claim 1 wherein said first waveguide member includes a mounting flange exteriorly of said conduit and said waveguide includes cooperating rivet means for securing said mounting flange to said wall means.

8. The microwave oven waveguide of claim 1 wherein said first waveguide member includes a mounting flange exteriorly of said conduit and said waveguide includes means securing said mounting flange to said wall means, said waveguide further including a capacitive seal means between said mounting flange and said wall means.

9. The microwave oven waveguide of claim 1 wherein said first waveguide member includes a mounting flange exteriorly of said conduit and means securing said mounting flange to said wall means, said wall means being provided with an external dielectric layer adjacent said opening providing a capacitive seal means between said mounting flange and said wall means.

10. The microwave oven waveguide of claim 1 wherein said first waveguide member includes a peripheral mounting flange exteriorly of said conduit and means securing a first portion of said mounting flange to said second waveguide member.

11. The microwave oven waveguide of claim 1 wherein said first and second waveguide members include joined peripheral mounting flanges approximately one inch in width.

12. The microwave oven waveguide of claim 1 wherein each of said first and second waveguide members includes a mounting flange secured to said wall means.

13. The microwave oven waveguide of claim 1 wherein each of said first and second waveguide members includes a mounting flange secured to said wall means by mechanical fastening means.

14. The microwave oven waveguide of claim 1 wherein each of said first and second waveguide members includes a mounting flange secured to said wall means by mechanical fastening means spaced apart a distance no greater than ¼ the wavelength of the microwave energy generated by said generating means.

15. The microwave oven waveguide of claim 1 wherein said waveguide members are formed of metal and provided with facially abutting flanges having continuous, uniform metal-to-metal contact providing a microwave seal therebetween.

16. The microwave oven waveguide of claim 1 wherein said guide means comprises a plurality of mechanically interfastened wall portions.

17. The microwave oven waveguide of claim 1 wherein a capacitive seal is provided between said second waveguide member and said wall means about said wall means inlet opening.

18. The microwave oven waveguide of claim 1 wherein threaded securing means are provided for securing the generating means to the waveguide.

19. The microwave oven waveguide of claim 18 wherein said securing means further at least partially secures said first waveguide member to said second waveguide member.

* * * * *